United States Patent [19]

Gaffney

[11] Patent Number: 4,909,569

[45] Date of Patent: Mar. 20, 1990

[54] LIFT CHAIR

[76] Inventor: Edward J. Gaffney, N26 W27293 Highway SS, Pewaukee, Wis. 53072

[21] Appl. No.: 374,481

[22] Filed: Jun. 30, 1989

Related U.S. Application Data

[63] Continuation of Ser. No. 270,482, Nov. 4, 1988, which is a continuation of Ser. No. 158,083, Feb. 16, 1988, which is a continuation of Ser. No. 932,189, Nov. 18, 1986.

[51] Int. Cl.[4] ..... A97S 19/00

[52] U.S. Cl. ..... 297/330; 297/327

[58] Field of Search ..... 297/330, 321, 326, 327, 297/328, 325

[56] References Cited

U.S. PATENT DOCUMENTS

| | | | |
|---|---|---|---|
| 1,545,269 | 7/1925 | Munroe | 297/328 |
| 3,147,038 | 9/1964 | Barabas | 297/330 X |
| 3,765,720 | 10/1973 | Sakai | 297/330 |
| 4,083,599 | 4/1978 | Gaffney | 297/330 X |
| 4,307,912 | 12/1981 | Watt et al. | 297/321 X |
| 4,339,103 | 7/1982 | Mori et al. | 297/327 X |
| 4,453,766 | 6/1984 | DiVito | 297/330 X |
| 4,616,874 | 10/1986 | Pietsch et al. | 297/321 |

FOREIGN PATENT DOCUMENTS

| | | | |
|---|---|---|---|
| 2081082 | 2/1982 | United Kingdom | 297/330 |

*Primary Examiner*—Peter A. Aschenbrenner
*Attorney, Agent, or Firm*—Fuller, Ryan & Hohenfeldt

[57] ABSTRACT

Disclosed herein is a base for a recliner lift chair in which the push links and flying links are dimensioned to provide constant velocity motion to the seat and back without dwell during movement in the lifting and reclining modes. The base is provided with a flexible tie to afford shifting of the base members to accommodate uneven floors and maintain four-point contact.

4 Claims, 4 Drawing Sheets

LIFT CHAIR

This is a continuation of Ser. No. 270,482, filed Nov. 4, 1988, which was a continuation of Ser. No. 158,083, filed Feb. 16, 1988, which is a continuation of Ser. No. 932,189, filed on Nov. 18, 1986.

BACKGROUND OF THE INVENTION

This invention relates to base frames and base linkages for power driven reclining lift chairs.

In reclining chairs a tiltable back and seat are driven between an erect and a reclined position, and a leg or foot rest is driven between a retracted and an extended position. A lift chair is powered between a normal seat position and an elevated forwardly inclined position. In various prior art reclining lift chairs the speed of motion or velocity of the back or seat or the leg rest as sensed by the chair occupant changes or varies during the course of movements in the elevating or reclining mode. Additionally, in some prior art chairs there is some dwell that occurs at certain points in the motion. Because of the attitude of the flying links in prior art chairs there is no vertical tie in the reclining hinge, and the seat is unstable. In the prior art devices the linkages are not always force-loaded, and accordingly there is a dwell and hence intermittent motion prior to full loading of the links. The dwell and velocity changes make the chairs perform with erratic, non-uniform movements that are disconcerting to the elderly users of the chairs. Play in the driving linkages of the prior art chairs also contributes to the non-uniform motion of the chairs.

SUMMARY OF THE INVENTION

This invention provides an elevator reclining lift chair base with a base linkage that connects to a reclining hinge linkage. The lift chair base can be used with either a two-way reclining hinge or a three-way reclining hinge. With a two-way hinge, the seat and back are in fixed relationship. With a three-way hinge, the back moves independently of the seat. The base has a reclining linkage with flying links that have a certain selected length with respect to the length of push links to provide relatively constant apparent motion of the seat, back, and foot rest as those chair elements move between the normal position, the reclined position, and the elevated or lift position. In addition, the selection of link lengths results in the linkage being continually loaded so there is no dwell in the course of linkage movement between the various positions and during movement in each of the modes. Hence, the motion sensed by the occupant is constant or uniform and approximately the same in both modes.

The links with a pre-selected length include flying links in which the attitude of the links is maintained at an angle greater than 0° and less than 90° relative to the vertical throughout all chair functions. This causes the flying links to be intentional during lifting and in compression during reclining. As a result, the flying links provide a generally vertical tie to the generally horizontally disposed hinge linkage mounting rails to prevent inadvertent separation of the hinge linkage during a shift of the occupant in the chair, which can cause a shift and movement of the seat.

Other features of the invention include a base frame that has two parallel horizontal floor engaging base frame members interconnected at the rear by a perpendicularly related base tie member with the front ends of the parallel members turned outwardly to form front legs. A somewhat flexible metal strap connects the parallel base frame members intermediate the lengths thereof and provides flexibility in the frame to accommodate differences in level of the floor or supporting surface while providing sufficient torsional structural rigidity. No adjustable feet are required to level the chair as with prior art bases. Rubber caps on the ends of the outturned frame portions provide cushioned engagement with the floor. The need for the adjustable feet of the prior art recliner lift chairs is eliminated.

Further objects, advantages, and features of the invention will be apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 4:
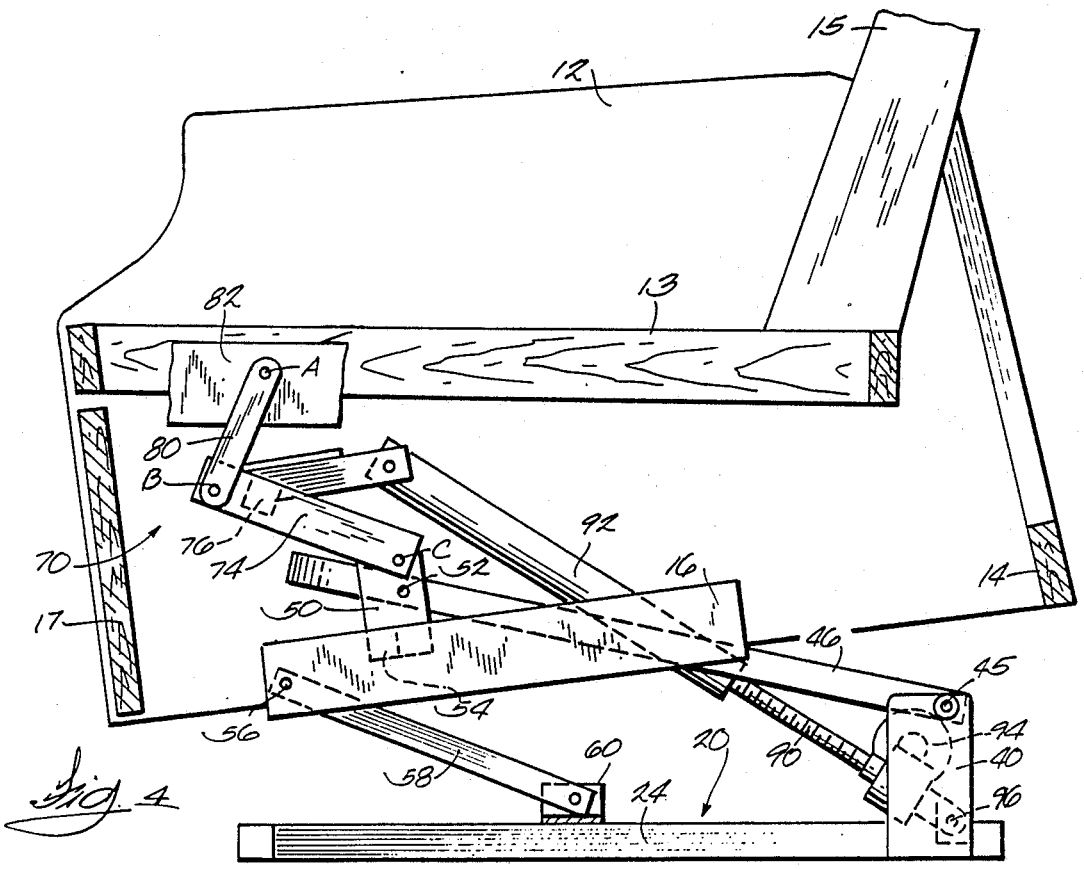
FIG. 4 is a side elevational view with the chair in an intermediate elevated position above the base.
Figure 5:
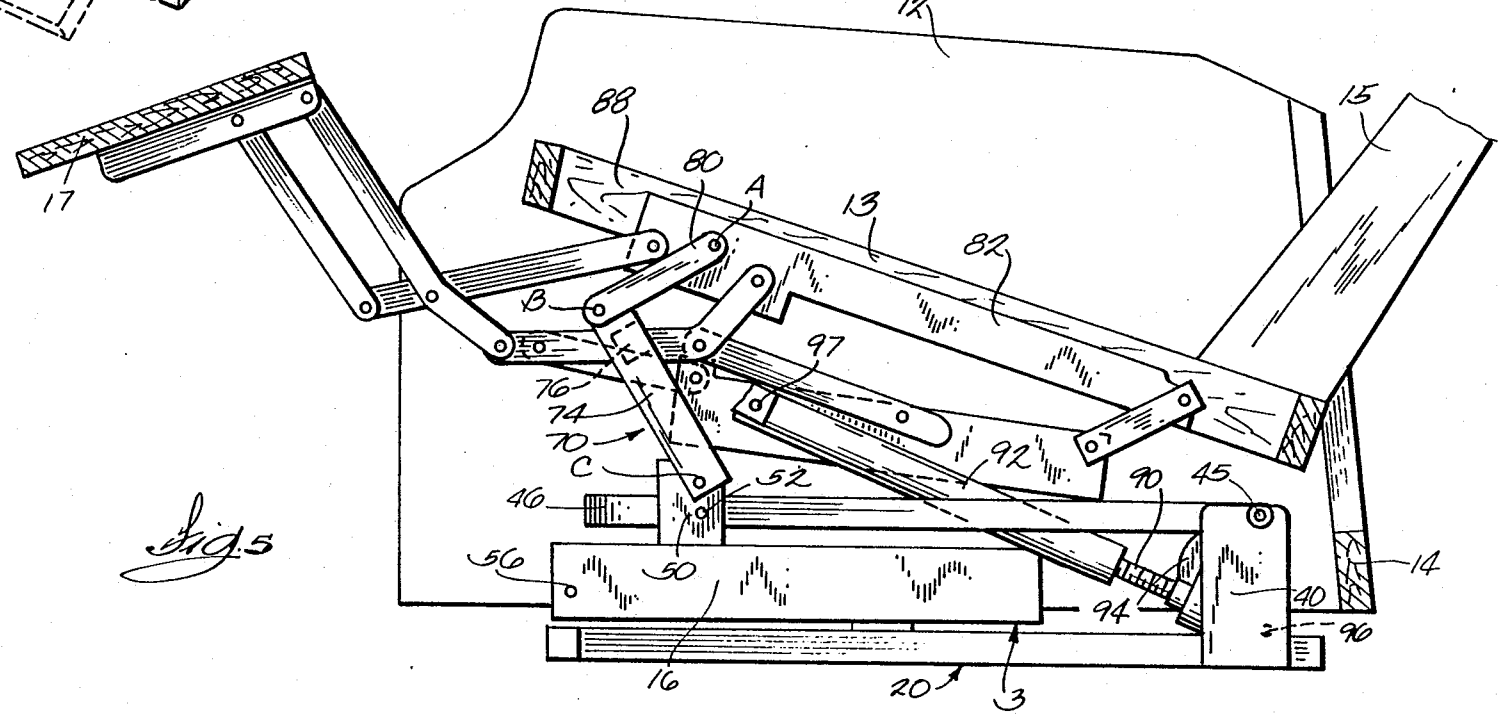
FIG. 5 is a side elevational view of the chair in the reclining mode.
Figure 6:
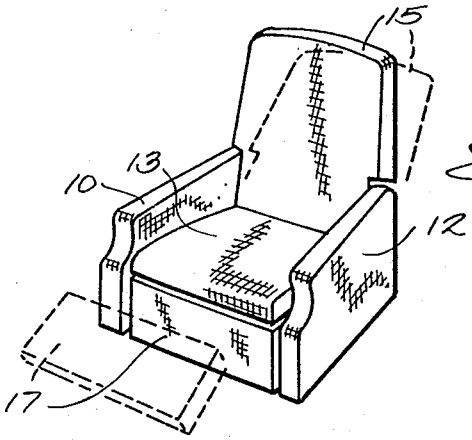
FIG. 6 is a diagrammatic perspective view of the chair parts.

FIG. 6 shows the general organization of the conventional chair parts. A pair of spaced side panels 10 and 12, which also provide the arm rests, have a wooden frame, not shown in detail, that is covered with an upholstery fabric. The side panels 10 and 12 are normally secured together at the rear by a wooden tie 14 shown in FIG. 5. The side panels 10 and 12 are supported on rails 16 (FIG. 5) that form part of a base linkage 3. The spaced rails 16 are fixedly secured to the wooden frames of the side panels 10 and 12 by fasteners, not shown. The side panels elevate from the FIG. 1 position to the FIG. 4 position and beyond during the lifting mode, with the seat 13 and integrally formed back 15 remaining at a constant angle relative to each other. When a three-way standard reclining hinge is used, such as the Leggett & Platt No. 8254, the back is adjustable independently of the seat. A footrest panel 17 moves between the vertical solid line position and the broken line position during reclining, FIG. 4.

Figure 1:
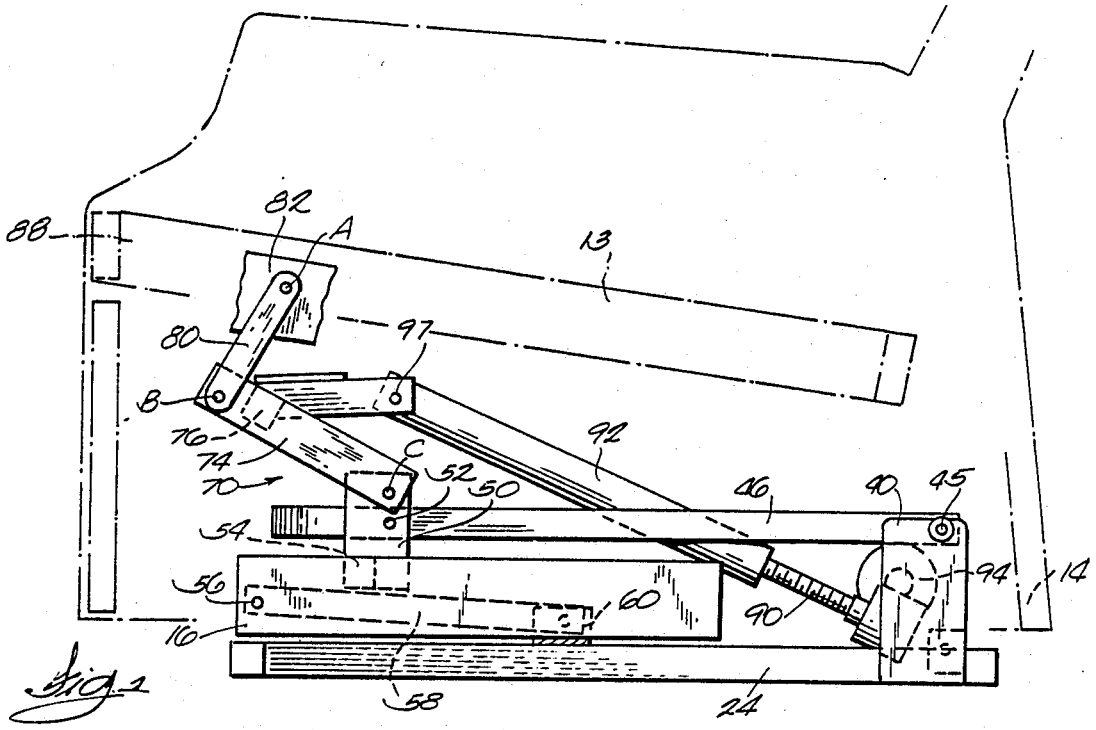
FIG. 1 is a fragmentary side elevational view of the base and base linkage embodying the invention.
Figure 2:
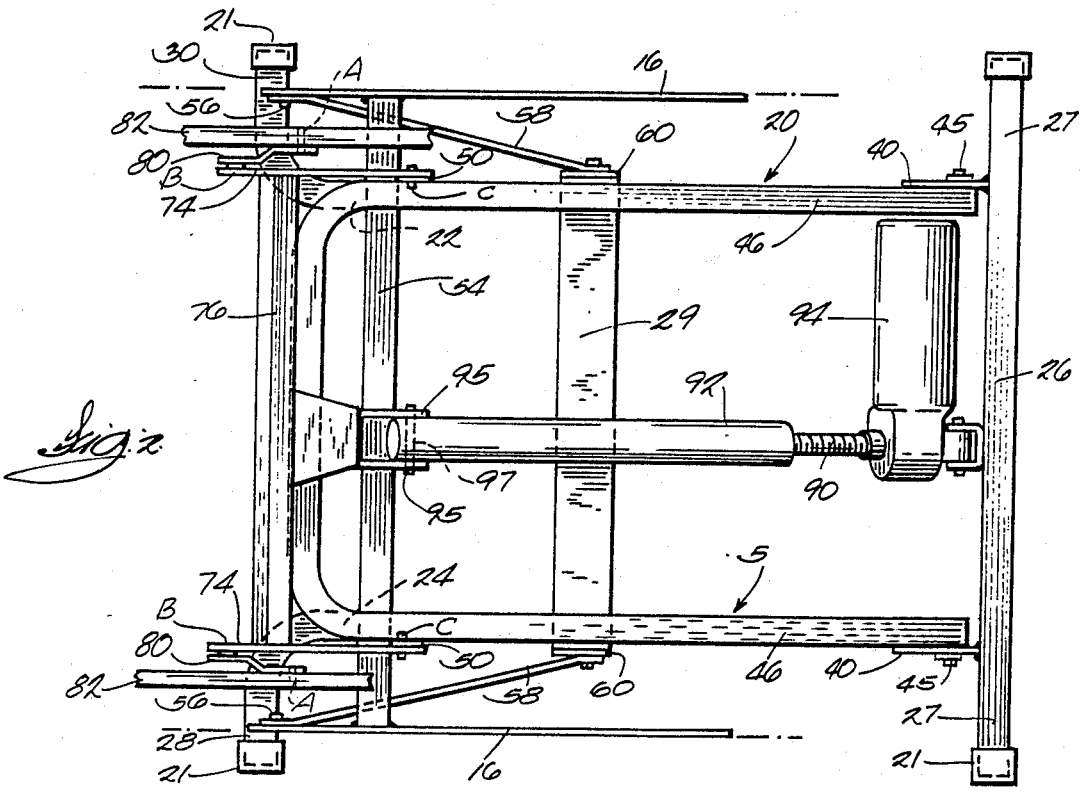
FIG. 2 is a partial plan view of the base illustrated in FIG. 1.
Figure 1A:
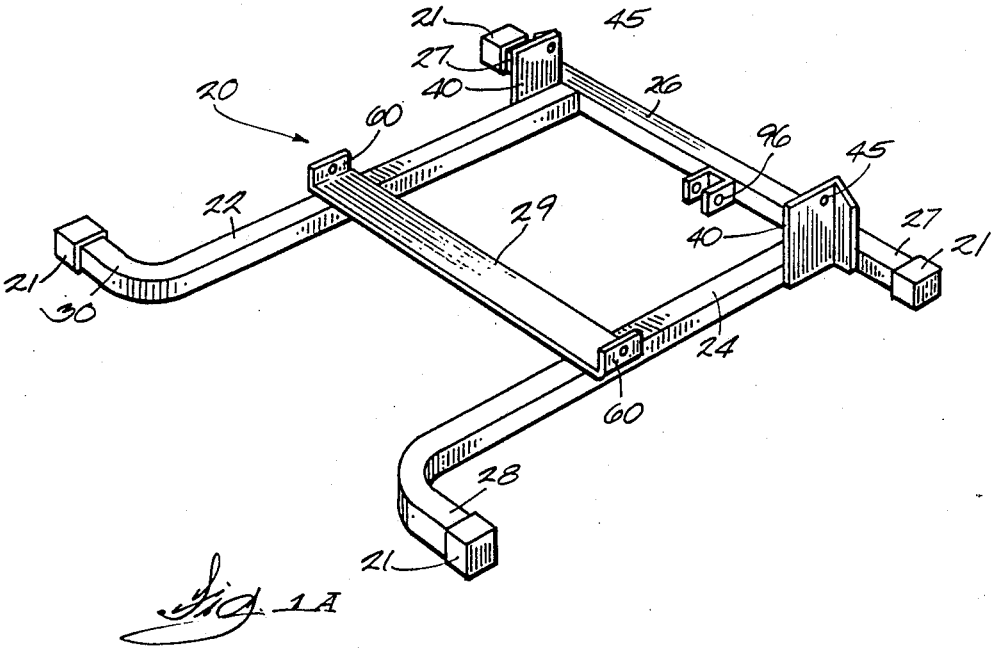
FIG. 1A is a perspective view of the base frame.

The chair components are supported on the floor by a base frame 20 (FIGS. 1A and 2). All of the components of the base frame 20 remain in floor engagement or closely spaced thereto in a horizontal parallel attitude. Rubber feet 21 (FIG. 2) elevate the base frame members slightly from the supporting surface. The base frame 20 includes two parallel horizontal metal frame members 22 and 24 that are interconnected at the rear by a cross-frame member 26 welded thereto with projecting leg portions 27 that receive the rubber feet 21. Connecting means in the form of a thin metal web or tie 29 is welded between the members 22 and 24. The forward ends of the members 22 and 24 are provided with integrally formed outturned leg portions 28 and 30, which can be provided with rubber feet or caps 21. The frame 20 has no tie between the leg portions 28 and 30. Hence the thin web 29 affords a limited amount of flexibility of the frame 20 to accommodate unevenness in the floor or supporting surface to ensure four point contact with the floor through the rubber feet 21.

The chair seat 13, back 15, and side panels 10 and 12 are supported above the base frame 20 by the base linkage 3. The base linkage includes a pair of upstanding tabs 40 welded to the spaced members 22 and 24. A pair of elongated arms 46, part of a U-shaped frame 5, are pivotally connected by pivots 45 to the tabs 40 and extend forwardly and are pivotally connected to pivot plates 50 by pivots 52. The pivot plates 50 are interconnected by a cross member 54, which has its ends welded to the spaced rails 16 that carry the chair side panels 10 and 12. The forward ends of the rails 16 are pivotally connected by pivots 56 to links 58. The links 58 are pivotally connected at their respective back ends to upturned tabs 60 on web 29 and hence are connected to the base frame 20. Thus, there are two connections of the rails 16 to the base frame, links 58 and arms 46. The arms 46 and links 58 support the entire chair above the base frame 20, which remains in floor contact. The movement of the rails 16 with respect to the base frame 20 via the links and arms by a powered actuator as subsequently described determines the position of the entire chair, including the side panels 10 and 12, relative to the floor.

Figure 3:
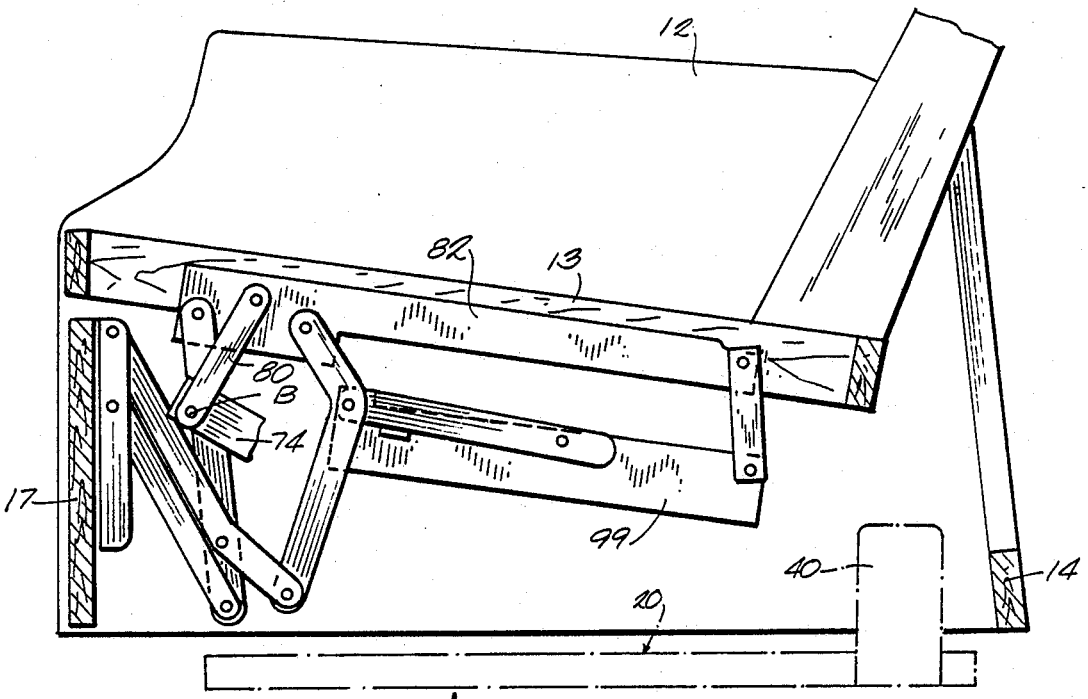
FIG. 3 is a side elevational view similar to FIG. 1 showing the reclining hinge linkage with the chair in a normal position and attitude.

The attitude of the seat 13 and back 15 in the reclined position is determined by a reclining hinge linkage 70 (FIG. 4), which includes a pair of push links 74 fixedly connected together by a cross-tube 76 (FIG. 2). The push links 74, also identified herein as BC, have pivots B and C, with pivots C connected to the pivot plates 50. Pivots B are connected to a pair of flying links 80, also identified as AB, which are connected to the upper members 82 of the reclining hinge linkage 70, as shown in FIG. 3. FIG. 3 has the base linkage 3 removed for clarity.

There is a separate reclining hinge linkage 70 on each side of the chair as shown in U.S. Pat. No. 4,007,960, which is incorporated herein by reference. The hinge linkage upper members 82 are secured to the wooden side rails 88 of the seat 13 by bolts or screws, not illustrated herein, through apertures in the members 82. The reclining hinge linkage depicted is a standard Leggett & Platt hinge No. 8500, which is commonly used in reclining chairs having a seat and back in fixed relationship. At the outward end of the reclining hinge linkage is the footrest 17. The reclining hinge linkage is movable from the collapsed or folded position shown in FIG. 3 to the extended position in FIG. 5.

Powered movement of the push links 74 or BC is afforded by an actuator that includes a screw 90 and a screw housing 92 powered by a gear drive unit and motor 94. The gear drive unit and motor 94 are pivotally connected to the base frame 20 at 96 to swing about the base frame as the attitude of the seat 13 and back 15 changes. The housing 92 is connected to the cross-tube 76 by a pair of spaced brackets 95 and a clevis pin 97. The screw 90 is driven by the gear drive unit. The gear drive unit is actuated by a control switch (not shown) to provide forward and reverse movement of the screw.

Figure 7:
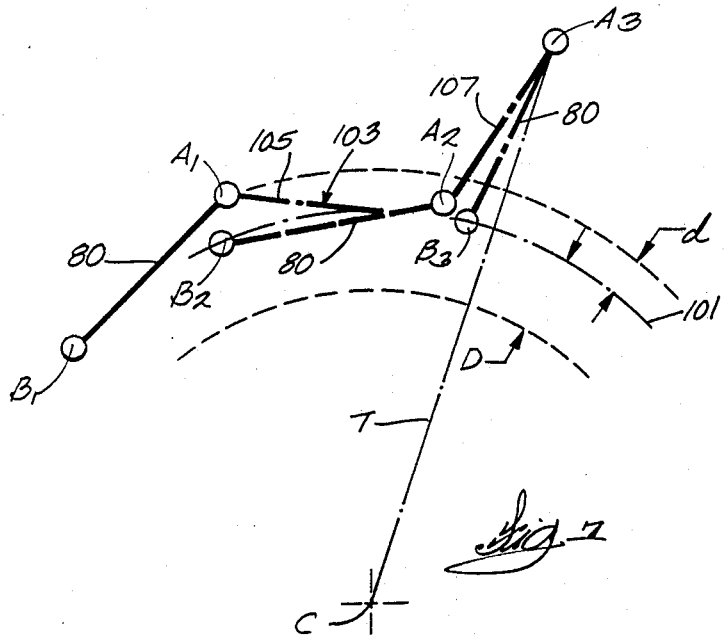
FIG. 7 is a diagram of the paths of travel of links AB and BC between the normal seat position and the reclined position.

Referring to FIG. 7, the flying links AB range between an angle greater than 0° and less than 90° relative to the vertical. This provides a vertical tie between the upper hinge member 82 and the base linkage 3, FIG. 5, to prevent the members 82 and 99 (FIG. 3) from pulling apart when an occupant abruptly shifts and leans rearwardly in the chair. This can cause the seat and back to shift or jerk.

In accordance with the invention, the lengths of the links AB and BC are selected to maintain links AB in tension during lifting and in compression during reclining movements. In addition, the links are selected to maintain uniform motion or uniform sensed movement by the chair occupant without dwell or sudden surges of movement. It has been found that the following lengths of push links BC and flying links AB accomplish these objectives. With push links of 8, 6, and 4 inches, the respective corresponding flying links are desirably 2, 4 and 6 inches in length between pivots. The preferred embodiment uses a push link BC length of approximately 6.25 inches and a flying link AB length of approximately 4 inches.

FIG. 7 shows the paths of the flying link pivots A and B as the chair reclines from the normal erect position of FIG. 1. When the power gear drive unit and motor 94 are actuated in the reclining mode, the push links 74 rotate clockwise with respect to FIGS. 1 and 5 about their respective pivots C. Consequently, pivot B of each push link travels in an arcuate path 101 about its pivot C. Points $B_1$, $B_2$, and $B_3$ represent three locations of the pivot B along the arcuate path 101.

The pivot A of each flying link 80 travels along a path, generally indicated at reference numeral 103, that contains points $A_1$, $A_2$, and $A_3$. The points $A_1$, $A_2$, and $A_3$ correspond to the respective pivot points $B_1$, $B_2$, and $B_3$. The points $B_1$, $B_2$, and $B_3$ and $A_1$, $A_2$, and $A_3$ correspond to the locations of the pivots B and A, respectively, as the chair reclines from the erect position of FIG. 1 through the partially reclined position of FIG. 5 and to the fully reclined position, not shown. It will be noticed that the path of pivot A includes a first portion 105 that is generally tangential to the arc 101 and a second portion 107 that is generally radial to the arc 101. Point $A_2$ has been chosen arbitrarily at approximately the intersection of the two path portions 105 and 107.

To maintain the flying links 80 in compression during reclining and to produce uniform smooth sensed movement by the chair occupant during reclining, it has been found by geometric layouts that the lengths of the AB and BC should satisfy two relationships with respect to the paths 101 and 103 of the points B and A, respectively. The first requirement is that the location of the intersection of the path portions 105 and 107 of the pivot A should fall within a predetermined distance of the arc 101. Specifically, I have found that the intersection of the path portions 105 and 107 should not be above arc 101 by a distance d greater than 0.70 inches nor below it by a distance D greater than 2.00 inches.

The second condition is that the lengths of the links AB and BC should be such that the distance BC plus AB minus X equals the distance between points $A_3$ and C and wherein X should be less than 2.00 inches. It is noted that the distance range of variation for X is not related to the distances D and d. For typical recliner chairs such as are in wide spread use, the distance between pivot C and point $A_3$ is usually less than about 10.00 inches. In those types of chairs, excellent results are obtained when link AB has a length of approximately 4 inches and link BC has a length of approximately 6.25 inches.

In operation of the chair, the movement of the reclining linkage 70 and the base linkage 3 is illustrated in FIGS. 3, 4, 5, and 7. Selection of the links AB and BC as described herein will provide uniform smooth movement of the seat and back and footrest without the intermittent and jerky movement found in prior art chairs.

I claim:

1. A reclining lift chair having a seat and back that are selectively positionable between an erect occupant position and a reclined occupant position in a movement that is sensed by a chair occupant to be smooth and uniform comprising:

a. a chair frame having spaced side panels;

b. a base frame for being supported on a support surface;

c. a base linkage comprising:

i. a pair of spaced side rails secured to the respective chair frame side panels; and ii. linkage means pivotally connecting the side rails to the base frame for enabling the chair to be lifted and lowered relative to the support surface;

d. a pair of push links, each push link having a first pivot C pivotally connected to a respective base linkage side rail and a second pivot point;

e. a pair of flying links, each flying link having a first pivot A pivotally connected to the chair seat and a second pivot point pivotally connected to the second pivot point of an associated push link to create a common pivot B therebetween; and f. actuator means joined to the base frame and the push links for providing motion therebetween to selectively position the seat and back between the erect and reclined occupant positions and to selectively lift and lower the chair relative to the support surface, the common pivot B of each flying link and push link defining an arcuate path about the push link first pivot C that contains points $B_1$, $B_2$, and $B_3$ and the first pivot A of each flying link defining a path having a first portion containing points $A_1$ and $A_2$ that is generally tangential to the arcuate path of the common pivot B and a second portion containing points $A_2$ and $A_3$ that is generally radial of the arcuate path of the common pivot B when the actuator means positions the seat and back between erect and reclined occupant positions, the points $A_1$, $A_2$, and $A_3$ corresponding with the points $B_1$, $B_2$, and $B_3$, respectively, of the common pivot B, the point of intersection of the first and second path portions of each flying link first pivot A being spaced a distance ranging from approximately 0.70 inches farther from to approximately 2.00 inches closer to the push link first pivot C than the arcuate path of the common pivot B, the sum of the distance between the pivot A and the second pivot point of each flying link plus the distance between the pivot C and the second pivot point of each push link being less than 2.00 inches longer than the distance between the point $A_3$ and the push link first pivot C.

2. The reclining lift chair of claim 1 wherein the lengths of the flying links between the respective first pivots A and the second pivot points is approximately 4.00 inches, and wherein the lengths of the push links between the respective first pivots C and the second pivot points is approximately 6.25 inches.

3. In a reclining lift chair having a pair of spaced side panels; a seat and back pivotally connected to the side panels; a base frame for being supported on a support surface; base linkage means for pivotally connecting the chair side panels to the base frame to enable the chair to be lifted and lowered relative to the support surface; reclining hinge means pivotally secured to the base linkage means for selectively positioning the seat and back between an erect occupant position and a reclined occupant position; and actuator means joined to the base frame and the reclining hinge means for providing movement therebetween to selectively position the seat and back between the erect and reclined occupant positions and to selectively lift and lower the chair relative to the support surface, the improvement wherein:

a. the reclining hinge means comprises:

i. a pair of push links, each push link having a first pivot C pivotally connected to the base linkage means and a second pivot point; and ii. a pair of flying links, each flying link having a first pivot A pivotally connected to the chair seat and a second pivot point pivotally connected to the second pivot point of an associated push link to create a common pivot B therebetween; and b. the common pivot B of the flying link and the push link defines an arcuate path about the push link first pivot C and contains points $B_1$, $B_2$, and $B_3$;

c. the first pivot A of each flying link defines a path having a first portion containing points $A_1$ and $A_2$ that is generally tangential to the arcuate path of the common pivot B and a second portion containing points $A_2$ and $A_3$ that is generally radial of the arcuate path of the common pivot B when the actuator means positions the seat and back between the erect and reclined occupant positions, the points $A_1$, $A_2$, and $A_3$ corresponding with the points $B_1$, $B_2$, and $B_3$, respectively, of the common pivot B;

d. the point of intersection of the first and second path portions of each flying link first pivot A is spaced a distance ranging from approximately 0.70 inches farther from to approximately 2.00 inches closer to the push link first pivot C than the arcuate path bf the common pivot B; and e. the sum of the distance between the pivot A and the second pivot point of each flying link plus the distance between the pivot C and the second pivot point of each push link is being less than approximately 2.00 inches shorter than the distance between the point $A_3$ and the push link first pivot C, so that a person sitting in the chair senses uniform velocity of the chair seat and back as the chair actuator means positions the seat and back between the erect and the reclined occupant positions.

4. The improvement of claim 3 wherein the length of each push link between the first pivot C thereof and the pivot B common with the associated flying link is approximately 6.25 inches, and wherein the length of each flying link between the first pivot A thereof and the pivot B common with the associated push link is approximately 4.00 inches.

* * * * *